US010477973B2

(12) United States Patent
Gerbino et al.

(10) Patent No.: US 10,477,973 B2
(45) Date of Patent: Nov. 19, 2019

(54) ERGONOMIC CHAIR

(71) Applicant: ErgoGenesis Workplace Solutions, LLC, Navasota, TX (US)

(72) Inventors: Anthony Gerbino, Navasota, TX (US); Bernie Lynch, Navasota, TX (US); Miles Keller, Toronto (CA)

( * ) Notice: Subject to any disclaimer, the term of this patent is extended or adjusted under 35 U.S.C. 154(b) by 0 days.

(21) Appl. No.: 15/340,168

(22) Filed: Nov. 1, 2016

(65) Prior Publication Data

US 2018/0116405 A1 May 3, 2018

(51) Int. Cl.
*A47C 7/14* (2006.01)
*A47C 7/44* (2006.01)
*A47C 7/46* (2006.01)

(52) U.S. Cl.
CPC ..... *A47C 7/462* (2013.01)

(58) Field of Classification Search
CPC ..... A47C 7/462
USPC ..... 297/284.4, 284.7, 452.56
See application file for complete search history.

(56) References Cited

U.S. PATENT DOCUMENTS 6,354,662 B1 * 3/2002 Su ..... A47C 7/46 297/284.4
6,419,318 B1 * 7/2002 Albright ..... A47C 7/462 297/284.4
6,568,760 B2 * 5/2003 Davis ..... A47C 1/03255 297/300.1
6,572,190 B2 * 6/2003 Koepke ..... A47C 1/03255 297/284.4 X
6,588,842 B2 * 7/2003 Stumpf ..... A47C 1/03 297/284.4
6,609,755 B2 * 8/2003 Koepke ..... A47C 1/03255 297/300.1
6,729,691 B2 * 5/2004 Koepke ..... A47C 1/03255 297/452.56 X
6,938,956 B1 * 9/2005 Piretti ..... A47C 7/38 297/284.7 X
7,249,802 B2 * 7/2007 Schmitz ..... A47C 1/03255 297/284.4
7,347,495 B2 * 3/2008 Beyer ..... A47C 7/462 297/284.4 X
7,665,805 B2 * 2/2010 Ueda ..... A47C 1/03255 297/301.1
7,712,833 B2 * 5/2010 Ueda ..... A47C 1/03255 297/296
7,717,513 B2 * 5/2010 Ueda ..... A47C 7/443 297/300.2

(Continued)

FOREIGN PATENT DOCUMENTS

CN 108968478 A * 12/2018 ..... A47C 7/462
KR 1967201 B1 * 4/2019 ..... A47C 7/462

*Primary Examiner* — Rodney B White
(74) *Attorney, Agent, or Firm* — Hasley Scarano, L.L.P.

(57) ABSTRACT

A chair, primarily for office use, is disclosed with a backrest that supports the user with a flexible mesh material combined with a frame that is shaped to project the mesh forward to support the user without coming into direct contact with the user. The central portion of the backrest frame is recessed relative to the top and bottom portions. The backrest frame is also bowed inward at the bottom with the top edge of the frame projected forward such that the mesh material supporting the user is suspended out and away from the main portion of the backrest frame.

17 Claims, 6 Drawing Sheets

(56) References Cited

U.S. PATENT DOCUMENTS 7,857,389 B2 * 12/2010 Ueda ..... A47C 1/03255 297/296
7,862,120 B2 * 1/2011 Ueda ..... A47C 1/03255 297/285
7,874,619 B2 * 1/2011 Harley ..... A47C 7/46 297/284.4
8,251,448 B2 * 8/2012 Machael ..... A47C 7/14 297/452.56 X
8,449,037 B2 * 5/2013 Behar ..... A47C 7/40 297/284.4 X
8,573,697 B1 * 11/2013 Su ..... A47C 7/462 297/284.7
8,764,110 B2 * 7/2014 Hsuan-Chin ..... A47C 7/44 297/284.7 X
8,991,922 B2 * 3/2015 Bisman ..... A47C 7/462 297/284.4
9,033,411 B2 * 5/2015 Mezzera ..... A47C 7/44 297/284.4 X
9,237,811 B1 * 1/2016 Cho ..... A47C 7/462
9,504,331 B2 * 11/2016 Machael ..... A47C 7/14
9,578,968 B2 * 2/2017 Masunaga ..... A47C 7/462
10,299,595 B2 * 5/2019 Diffrient ..... A47C 1/024
2002/0043841 A1 * 4/2002 Giacinto ..... A47C 7/38 297/284.4
2005/0062323 A1 * 3/2005 Dicks ..... A47C 7/38 297/284.4
2005/0104428 A1 * 5/2005 Walker ..... A47C 7/402 297/284.4
2007/0108818 A1 * 5/2007 Ueda ..... F16F 1/22 297/285
2007/0108820 A1 * 5/2007 Ueda ..... F16F 1/22 297/300.5
2011/0133531 A1 * 6/2011 Yeh ..... B60N 2/06 297/232
2012/0025575 A1 * 2/2012 Lin ..... A47C 1/026 297/311
2015/0164232 A1 * 6/2015 Mezzera ..... A47C 7/46 297/284.4
2015/0296989 A1 * 10/2015 Machael ..... A47C 7/44 297/284.7
2016/0360892 A1 * 12/2016 Neil ..... A47C 7/282
2016/0374474 A1 * 12/2016 Wu ..... A47C 7/462 297/284.4

* cited by examiner

FIG. 5
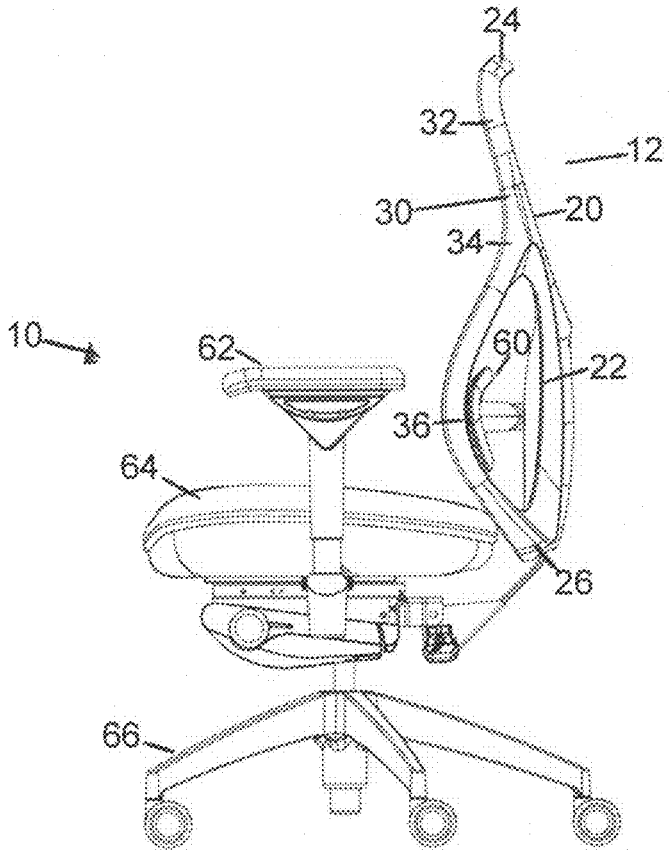
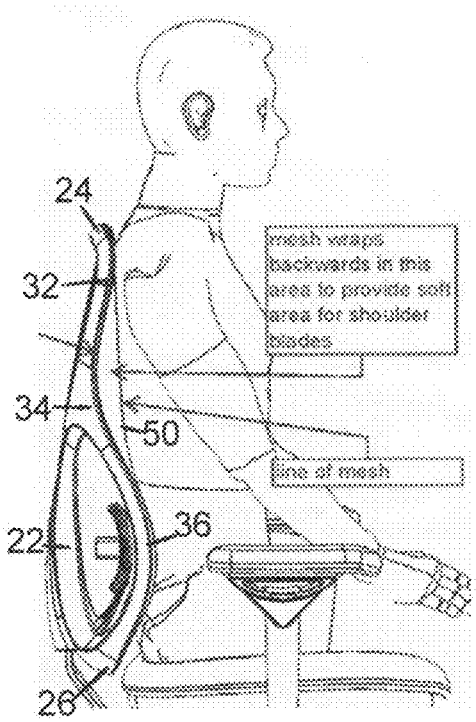
FIG. 6

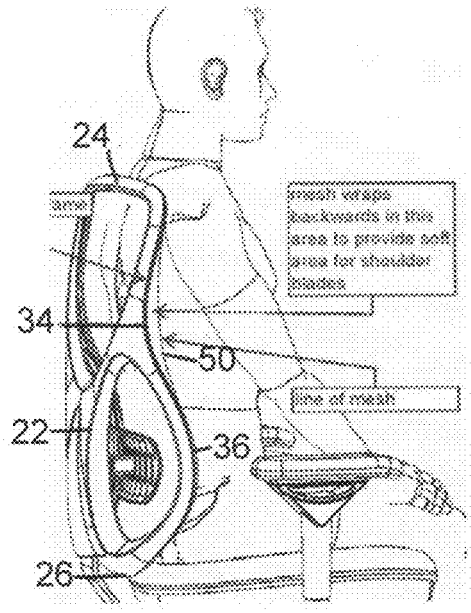
FIG. 7
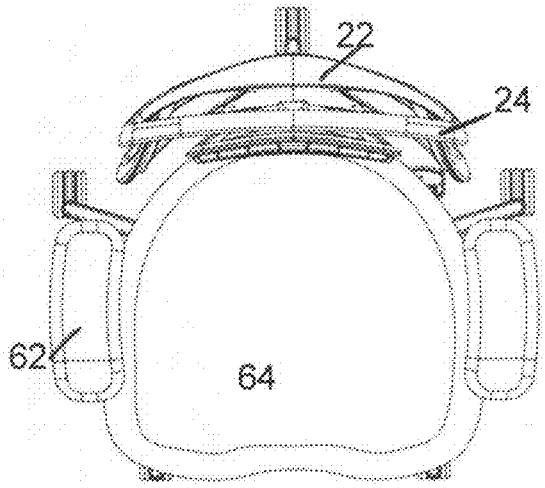
FIG. 8
FIG. 9
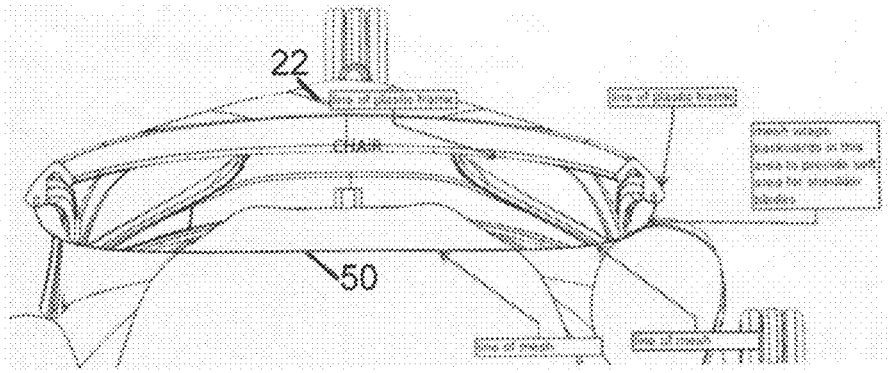

ERGONOMIC CHAIR

CROSS-REFERENCE TO RELATED APPLICATIONS

None.

STATEMENTS REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to a chair. More particularly, the present invention relates to a chair having a contoured flexible backrest, together with the methods of use and assembly.

2. Description of the Related Art

An office chair is a type of chair that is designed for use at a desk, in an office or at a conference table. Modern office chairs were first developed around the mid-19th century as more workers began spending significant amounts of time sitting at a desk. Special features, such as swivel seats, wheels, and adjustable height, not generally found on other chairs were adopted to help the chair bound workers with productivity. These conventional office chairs typically included seats and backrests utilizing single or multi-density foam padding covered by cloth, leather or the like. These type of chairs provided a deformable cushion to improve the user's comfort.

One problem with these conventional office chairs was that the cloth or leather material used on the backrests provided insufficient aeration and acted like a second layer of clothing making the user feel hotter. To overcome this problem, chair designers began making backrests of flexible mesh supported and attached to a rigid frame. An example of this type of chair is found in U.S. Pat. No. 6,588,842 to Stumpf et a/and its commercial embodiment the Herman Miller Aero chair. While these new type of office chairs addressed some problems, several other deficiencies became apparent. The rigid frame supporting the mesh material, typically a hard plastic material, could be very uncomfortable to the user. For example, the modern office work spends a significant amount of time keyboarding with their elbow projecting backwards into the hard rigid frame of the backrest.

Despite the development of office chairs in the past, there exists remains a need to provide an office chair that can provide adequate back support while keeping the user cool and avoiding the uncomfortable contact with the rigid backrest frame.

BRIEF SUMMARY OF THE INVENTION

The present invention includes a chair, primarily for office use, with a backrest that supports the user with a flexible mesh material combined with a uniquely shaped frame. The frame is shaped to project the mesh forward to support the user without coming into direct contact with the user. Preferably, the backrest frame is bowed inward at the bottom with the top edge of the frame projected forward such that the mesh material supporting the user is suspended out and away from the main portion of the backrest frame.

In a particular embodiment, the present invention comprises an improved ergonomic chair having a backrest frame with a central support, an upper edge, a lower edge, and two side edges. Each side edge comprises an upper side portion, a central side portion and lower side portion. A mesh backing material attaches to the frame along the upper edge, lower edge and side edges. The central support of the frame extends from the lower edge upwardly to connect to each side edge at the central side portion forming an opening on each side of the central support between the central support and the lower side portions of the side edges. A third opening is formed between the central support and the upper edge. The lower side portions are bowed inwardly away from the central support and the upper edge is projected forward relative to the central support. The width of the frame between the lower side portions is larger than the width between the central side portions and the width of the frame is wider between the upper side portions than the width between the central side portions. With the mesh backing material attached to the frame, the unique shape of the frame projects the mesh forward to support the user and minimizes the possibility of direct contact of the frame with the user.

Additional advantages of the invention are set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

A better understanding of the present invention can be obtained when the following detailed description of the disclosed embodiments is considered in conjunction with the following drawings in which:

FIG. 5 is a side view of the embodiment of FIG. 3;

FIG. 6 is a side view of an embodiment including a user utilizing a chair made in accord with the invention;

FIG. 7 is a rear-side perspective of the embodiment of FIG. 6;

FIG. 8 is a top view of the embodiment of FIG. 3;

FIG. 9 is a top view of a cross section of the embodiment of FIG. 6;

DETAILED DESCRIPTION OF THE INVENTION

The present invention includes a chair, primarily for office use, with a backrest that supports the user with a flexible mesh material combined with a uniquely shaped frame. The frame is shaped to project the mesh forward to support the user without coming into direct contact with the user. Preferably, the backrest frame is bowed inward at the bottom and has the top edge of the frame projected forward such that the mesh material supporting the user is suspended out and away from the main portion of the backrest frame. Preferably, the frame is narrower in the center than on either the top or the bottom of the frame.

Figure 1:
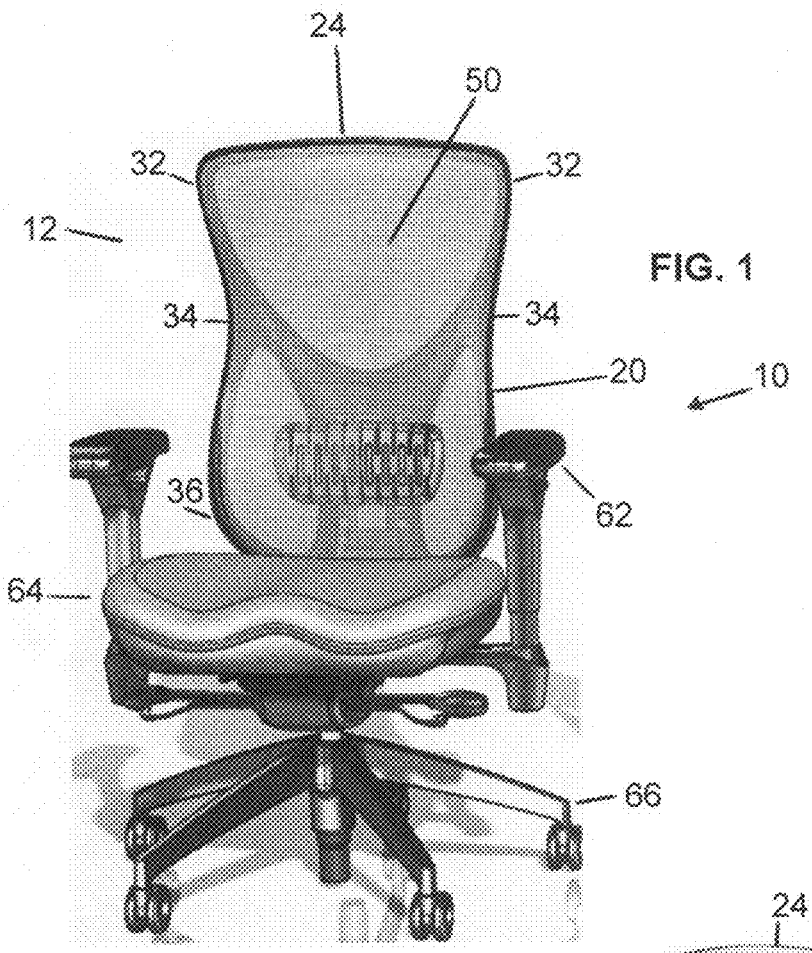
FIG. 1 is a front perspective view of an embodiment of chair made in accord with the invention.
Figure 2:
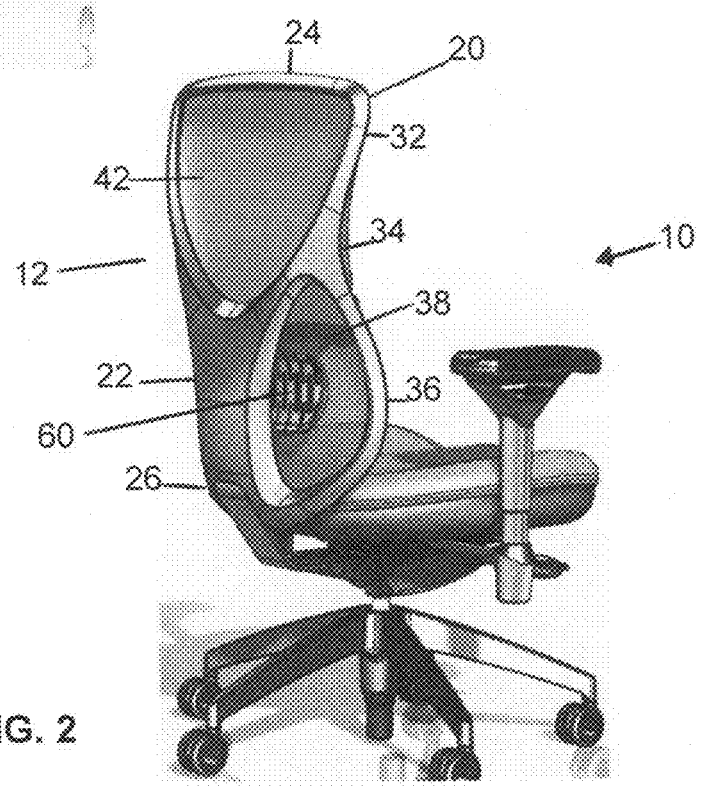
FIG. 2 is a rear-side perspective view of the embodiment of FIG. 1.
Figure 3:
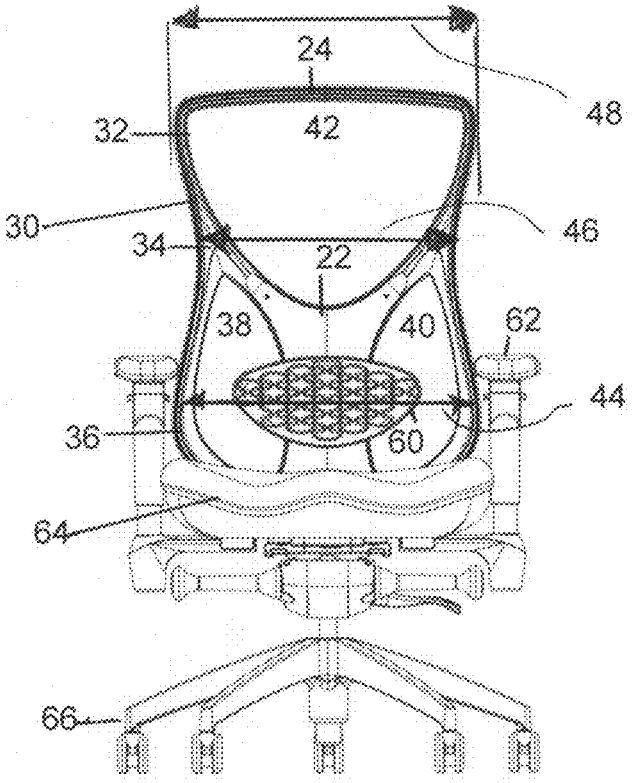
FIG. 3 is a front view of an embodiment of a chair made in accord with the invention.
Figure 4:
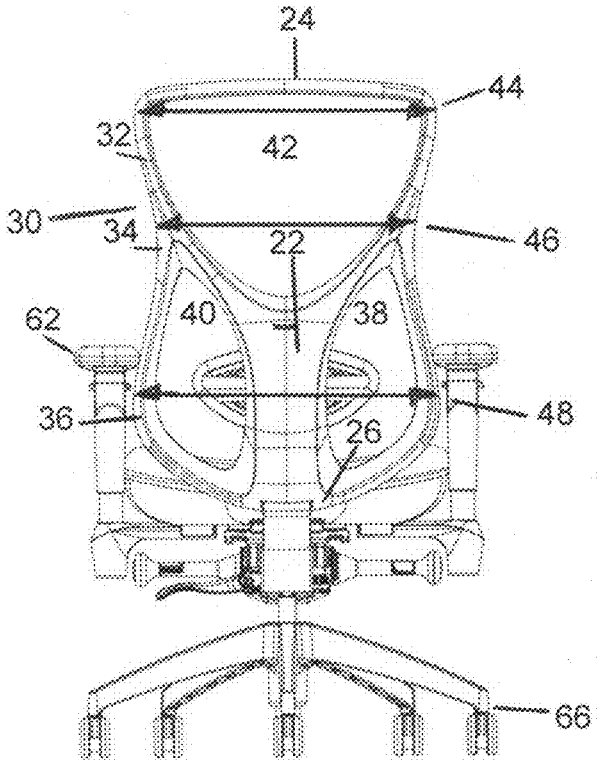
FIG. 4 is a rear view of the embodiment of FIG. 3.
Figure 10:
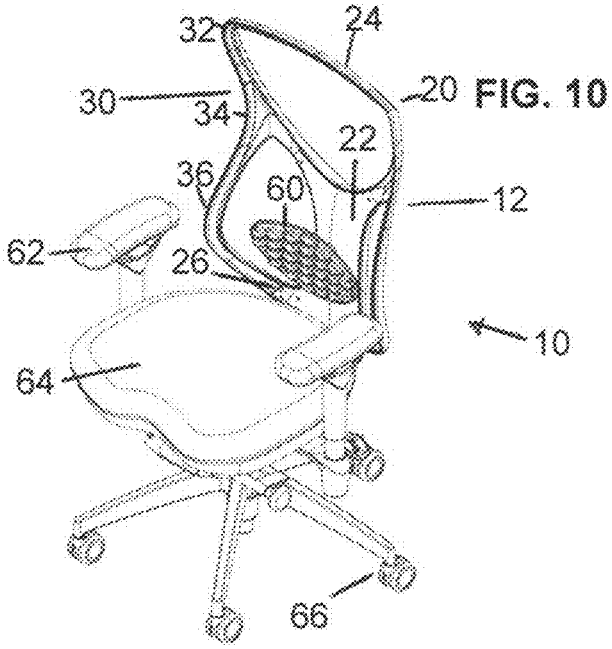
FIG. 10 is a front-side perspective view of the embodiment of FIG. 3.
Figure 11:
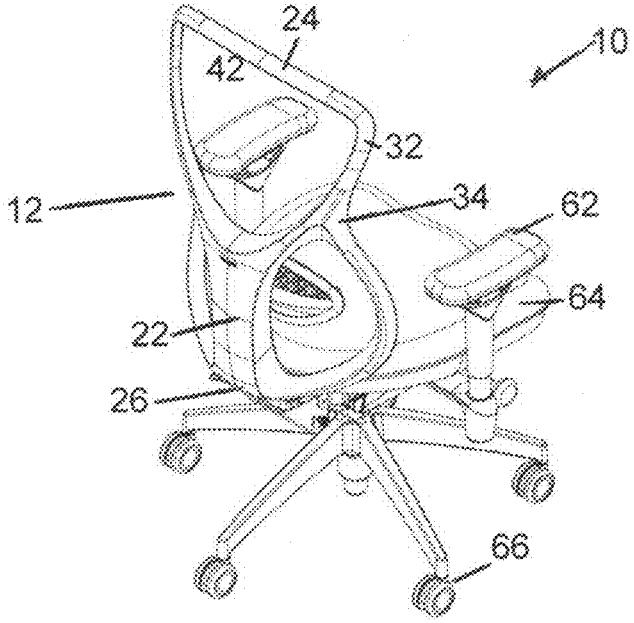
FIG. 11 is a rear-side perspective view of the embodiment of FIG. 3.
Figure 12:
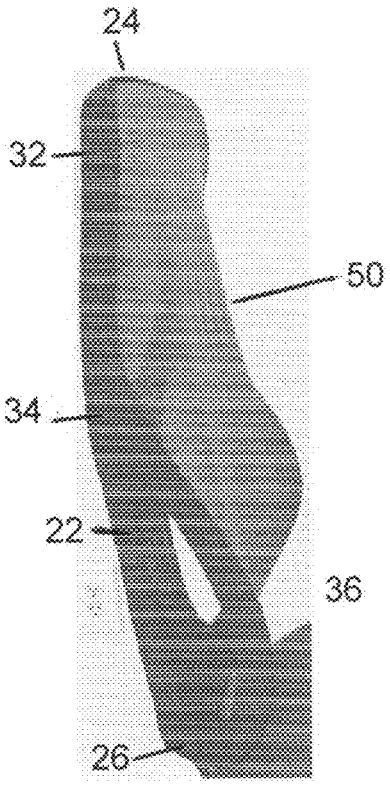
FIG. 12 is a front-side perspective view of an embodiment of chair backrest made in accord with the invention.
Figure 13:
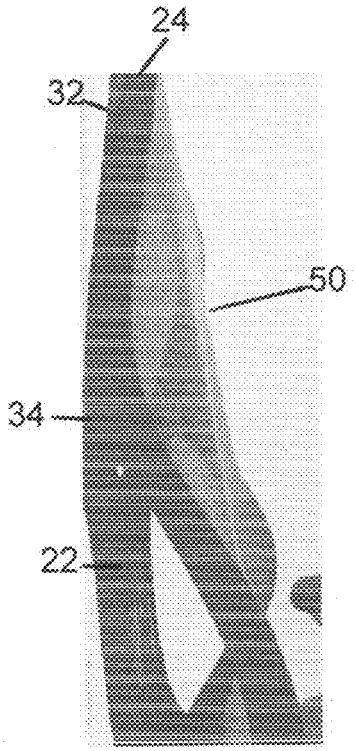
FIG. 13 is a side view of the embodiment of FIG. 12.
Figure 14:
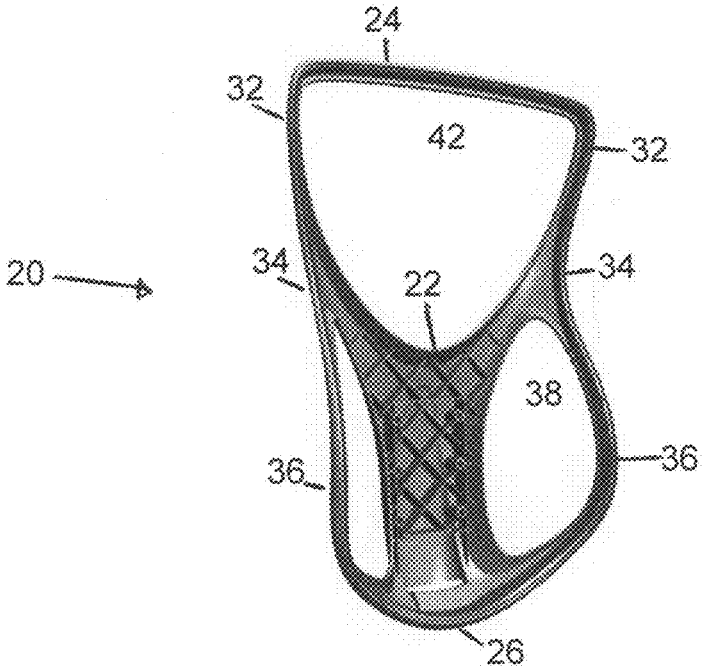
FIG. 14 is a rear perspective view of an embodiment of the frame suitable for use in the invention.

Referring to the FIG. 1, a chair 10 with an improved backrest 12 is shown. The backrest 12 is comprised of a specially contoured frame 20 and a mesh backing material 50 secured to frame 20. The frame 20 has a central support 22, two side edges 30, an upper edge 24, and a lower edge 26. The mesh material 50 is secured to frame 20 around the upper, lower, and side edges. Each side edges 30 of frame 20 include an upper portion 32, a central portion 34, and a lower portion 36.

As can be seen in FIGS. 1, 3, 5, 10 and 11, the front view of the backrest 12 shows one unique aspect of the present invention which is that the width 46 between the central portions 34 of the two side edges 30 is narrower than the width 48 between the two upper portions 32 at its widest part and narrower than the width 44 between the lower portions 36 at its widest part. Recessing in the central portions 34 relative to the upper 32 and lower portions 36 allows the user to pull their elbows backwards as with may be done for keyboarding on a computer without directly encountering the rigid frame 20 of the backrest 12. As can be seen, the preferred embodiment of the backrest 12 is generally symmetrical about a vertical axis as viewed from the front or the back. The various edges 24, 26, 30 of the backrest frame 20 can be curved or partially curved.

In preferred embodiments, the width 44 between the lower portions 36 of the side edges 30 should be between about 18 inches and about 21 inches, more preferably between about 19 and about 20 inches, and most preferably between about 19.25 and 19.75. In one preferred embodiment, the width 44 is about 19.5 inches. In preferred embodiments, the width 48 between the upper portions 32 of the side edges 30 should be between about 18 inches and about 21 inches, more preferably between about 18.75 and about 19.75 inches, and most preferably between about 19 and 19.5. In one preferred embodiment, the width 48 is about 19.25. In preferred embodiments, the width 46 between the central portions 34 of the side edges 30 should be between about 15 inches and about 18 inches, more preferably between about 16 and about 17 inches, and most preferably between about 16.25 and 16.75. In one preferred embodiment, the width 46 is about 16.5 inches. As a person of ordinary skill in the art will recognize from this disclosure, the central portions 32 of the side edges are recessed between about 7% and 9% relative to the lower portions 34 of the side edges 30, preferably between about 7.75 and 8.25 percent.

In addition to the recessed central portions 34 shown in the front and rear views of the backrest 12, the unique shape of the backrest frame 20 is preferably designed to project the seat back mesh material 50 forward and away from the frame 20. In particular, as is shown in FIGS. 5, 6, 8 and 9, the lower portions 36 of the side edges 30 are bowed inwardly (toward the seat) relative to the central support 22 of the frame 20. In preferred embodiments, the lower portions 36 of the side edges 30 are bowed between about 4.5 inches and about 6.5 inches relative to a general vertical plane formed by the central support 22, or more preferably, between about 5 and about 6 inches. Additionally, the upper portions 32 of the side edges 30 angle forward relative to the central support 22 such that the upper edge 24 extends outwardly in front of the central support 22. As a person of ordinary skill in the art will now recognize from this disclosure, the upper portions 32 of the side edges 30 are preferably angled forward relative to the central support 22 at an angle between about 14.5 and 16 degrees, more preferably, between about 15 and 15.5.

Meshbacking material 50 is preferably a durable and resilient ergonomic mesh that provides adequate ventilation, is non-static producing, and provides a four-way stretch. One material suitable for use in the invention as the mesh backing material is available from The Quantum Group Inc., 5280 National Center Drive, Colfax N.C. 27235, as Type W-02. This material is generally available in various weave colors including silver and/or black. This is a non-limiting example of suitable mesh backing material but other fabrics produced by other manufactures having generally similar properties are also suitable for use in the invention.

Preferably, the mesh fabric 50 is attached to the frame 20 using spline technology. One source for assembly utilizing spline technology is Leggett and Platt, but as will be recognized by those of ordinary skill in the art, other techniques and manufacturers can be utilized to attach the mesh material to the frame without departing from the scope of the invention. The specific geometry of the chair frame as described above, in combination with proper mesh tensioning technique, causes the mesh to take a straight line between the upper portions 32 of the side edges 30 and the lower portions 36 of the side, edges 30. When the mesh is fixed in the perimeter groove, the mesh is caused to wrap backwards towards the mid portion of the back 30. This creates an area of mesh with no rigid side support, resulting in a soft supportive area for a person's shoulders and shoulder blades.

As will now be recognized when the mesh material 50 is secured to the uniquely shaped frame 20 as shown in FIGS. 6, 7, 9, 12, and 13, the mesh material 50 is projected forward from the central support 22 across the whole of the frame 22. The shape of the frame 20 combined with the suspension of the mesh backing material 50 allow backrest 10 to suspend the users body without direct engagement with the hard plastic frame. In the preferred embodiments, when a user sits in the chair 10 having a backrest 12 of the present design, the user's back and shoulders will be supported by the mesh material 50 without any direct contact with the frame 20.

In preferred embodiments, a lumbar support pad 60 can be utilized with the backrest 12. Preferably, the lumbar support pad 20 is located between the central support 22 and the projected mesh material 50. Most preferably, the lumbar support pad 60 is adjustable to conform to the particular user of the chair 10. Other features of ergonomic office chairs such as chair anus 62, adjustable or not, a padded seat cushion 64, height adjustability, and roller systems 66 such as are known to those of skill in the art can also be utilized with the backrest 12.

While the terms used herein are believed to be well-understood by one of ordinary skill in the art, definitions are set forth to facilitate explanation of certain of the presently-disclosed subject matter.

Following long-standing patent law convention, the terms "a", "an", and "the" refer to one or more when used in this application, including the claims. Thus, for example, reference to "a window" includes a plurality of such windows, and so forth.

Unless otherwise indicated, all numbers expressing quantities of elements, dimensions such as width and area, and so forth used in the specification and claims are to be understood as being modified in all instances by the term "about". Accordingly, unless indicated to the contrary, the numerical parameters set forth, in this specification and claims are approximations that can vary depending upon the desired properties sought to be obtained by the presently-disclosed subject matter.

As used herein, the term "about," when referring to a value or to an amount of a dimension, area, percentage, etc., is meant to encompass variations of in some embodiments plus or minus 20%, in some embodiments plus or minus 10%, in some embodiments plus or minus 5%, M some embodiments plus or minus 1%, in some embodiments plus or minus 0.5%, and in some embodiments plus or minus 0.1% from the specified amount, as such variations are appropriate to perform the disclosed methods or employ the disclosed compositions.

The term "comprising", which is synonymous with "including" "containing" or "characterized by" is inclusive or open-ended and does not exclude additional, unrecited elements or method steps. "Comprising" is a term of art used in claim language which means that the named elements are essential, but other elements can be added and still form a construct within the scope of the claim.

As used herein, the phrase "consisting, of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter. With respect to the terms "comprising", "consisting of", and "consisting essentially of", where one of these three terms is used herein, the presently disclosed and claimed subject matter can include the use of either of the other two terms.

As used herein, the term "and/or" when used in the context of a listing of entities, refers to the entities being present singly or in combination. Thus, for example, the phrase "A, S, C, and/or O" includes A, S, C, and O individually, but also includes any and all combinations and subcombinations of A, S, C, and O.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. The foregoing disclosure and description are illustrative and explanatory thereof, and various changes in the details of the illustrated apparatus and construction and method of operation may be made without departing from the spirit in scope of the invention which is described by the following claims.

We claim:

1. An improved ergonomic chair comprising:

a backrest frame comprising a central support, an upper edge, a lower edge, two side edges with each side edge comprising upper, central and lower side portions; and a mesh material attached to the frame along the upper edge, lower edge and side edges;

wherein the central support of the frame extends from the lower edge upwardly to connect to each side edge at the central side portion, an opening is formed on each side of the central support between the central support and the lower side portions of the side edges, and a third opening is formed between the central support and the upper edge;

wherein the lower side portions are bowed inwardly away from the central support and the width of the frame between the lower side portions is larger than the width between the central side portions;

wherein the upper side portions and the upper edge are projected forward, relative to the central side portions;

wherein the width of the frame is wider between the upper side portions than the width between the central side portions; and wherein a portion of the mesh material at the level of the central side portions is projected outwardly forward relative to the central side portions of the frame.

2. The chair of claim 1, wherein the upper edge is projected forward by angling the upper side portions of the side edges forward relative to the central support.

3. The chair of claim 2, wherein the upper side portions of the side edges are formed at an angle of between 14.5 and 16.0 degrees relative to the central support.

4. The chair of claim 2, wherein the upper side portions of the side edges are formed at an angle of between 15.0 and 15.5 degrees relative to the central support.

5. The chair of claim 1, wherein the central side portions of the side edges are recessed between 7 and 9% relative to the lower side portions of the side edges.

6. The chair of claim 1, wherein the central side portions of the side edges are recessed between 7.75 and 8.25% relative to the lower side portions of the side edges.

7. The chair of claim 1, wherein the central side portions of the side edges are recessed between 7 and 9% relative to the upper side portions of the side edges.

8. The chair of claim 1, wherein the central side portions of the side edges are recessed between 7.75 and 8.25% relative to the upper side portions of the side edges.

9. The chair of claim 1, wherein a width between the lower side portions of the side edges is between 18.0 and 21.0 inches.

10. The chair of claim 1, wherein a width between the upper side portions of the side edges is between 18.0 and about 21.0 inches.

11. The chair of claim 1, wherein a width between the central side portions of the side edges is between 15.0 and 18.0 inches.

12. The chair of claim 1, wherein the central side portions of the side edges are recessed between 16 and 20% relative to the upper side portions of the side edges and wherein the central side portions of the side edges are recessed between 16 and 20% relative to the lower side portions of the side edges.

13. The chair of claim 1, wherein the lower side portions of the side edges are bowed inwardly relative to the central support between 4.5 and 6.5 inches.

14. The chair of claim 1, wherein the lower side portions of the side edges are bowed inwardly relative to the central support between 5.0 and 6.0 inches.

15. The chair of claim 1 further comprising a lumbar support pad positioned between the central support and the mesh backing material.

16. The chair of claim 15, wherein the lumbar support pad is adjustable.

17. An improved ergonomic chair comprising:

a backrest frame comprising a central support, an upper edge, a lower edge, two side edges with each side edge comprising upper, central and lower side portions; and a mesh material attached to the frame along the upper edge, lower edge and side edges;

wherein the central support of the frame extends from the lower edge upwardly to connect to each side edge at the central side portion, an opening is formed on each side of the central support between the central support and the lower side portions of the side edges, and a third opening is formed between the central support and the upper edge;

wherein the lower side portions are bowed inwardly away from the central support and the width of the frame between the lower side portions is between 16 and 20 percent larger than the width between the central side portions;

wherein the upper edge is projected forward at an angle of between 14.5 and 16.5 degrees relative to the central support; and wherein the width of the frame between the upper side portions is between 16 and 20 percent larger than the width between the central side portions.

* * * * *